United States Patent [19]

Ramella et al.

[11] 4,027,408

[45] June 7, 1977

[54] DIGGER TEETH WITH INTERLOCKING TOOTH ELEMENTS

[76] Inventors: Ferdinando Ramella, Via La Salle 72; Pier Vincenzo Ramella; Arnaldo Ramella, both of Via Generale Perotti 102, all of Grugliasco, Turin, Italy

[22] Filed: Jan. 21, 1976

[21] Appl. No.: 651,319

[30] Foreign Application Priority Data

Jan. 28, 1975 Italy ..... 67195/75

[52] U.S. Cl. ..... 37/141 T; 37/142 R

[51] Int. Cl.[2] ..... E02F 9/28

[58] Field of Search ..... 37/141 R, 141 T, 142 R, 37/142 A; 172/703, 713; 299/91–93; D39/1 R, 1 A, 1 B

[56] References Cited

UNITED STATES PATENTS

| | | | |
|---|---|---|---|
| 2,876,853 | 3/1959 | Christofferson | 37/142 R X |
| 3,550,293 | 12/1970 | Helton | 37/141 T |
| 3,845,578 | 11/1974 | Holmstrom | 37/142 R X |

FOREIGN PATENTS OR APPLICATIONS

| | | | |
|---|---|---|---|
| 1,205,070 | 9/1970 | United Kingdom | 37/142 R |

*Primary Examiner*—Edward M. Coven
*Assistant Examiner*—R. E. Suter
*Attorney, Agent, or Firm*—Sughrue, Rothwell, Mion, Zinn & Macpeak

[57] ABSTRACT

A two-part tooth for the scoop of an earth-moving machine, the tooth comprising a first tooth element adapted to be attached to one side of the bottom wall of the scoop and a second tooth element adapted to be attached to the other side of the bottom wall of the scoop. The two tooth elements are provided with interengaging parts by means of which they are linked together to resist separation. They are also bolted together through the wall of the scoop. One of the two tooth elements has a projecting tooth and serves as a removable tip, the other tooth element remaining in position on the scoop.

3 Claims, 9 Drawing Figures

DIGGER TEETH WITH INTERLOCKING TOOTH ELEMENTS

BACKGROUND OF THE INVENTION

The present invention relates to a tooth for the bucket or scoop of an earth-moving machine; such teeth are mounted on the free edge, or front, of the bottom wall of a bucket or scoop of such a machine. This front edge of a bucket or a scoop of an earth-moving machine acts, in use of the scoop, as a blade and the teeth with which it is provided serve to protect the edge and to penetrate the soil.

A number of problems occur in designing teeth for earth-moving machines due to the stresses to which these teeth are subject in operation and to the operations they have to perform. Teeth of this sort, in fact, are subjected, in operation, to considerable mechanical stresses, and to wear. They must, above all, have a form which facilitates their penetration into the ground, and they must, moreover, retain this form as long as possible during their operational life despite the wear to which they are subjected. The dimensions and shape of these teeth must also be able, as far as possible, to withstand the considerable forces which occur during operation. In addition, the connection of the teeth to the front edge of the bottom wall of the bucket or scoop must be sufficiently robust and secure, and the shape of the teeth must ensure good protection of the front edge of the said bottom wall.

In known constructions, the teeth for earth-moving machines comprise a tool body having an appendage for attaching the tooth to the front edge of the scoop. The said appendage may be in the form of a shank, or in the form of a fork. In the case of teeth connected to the scoop by a shank the shank is housed during operation in a tooth-holder casing, fixed to the front edge of the scoop, and is secured to this casing by means of a key or like means. In the case of teeth connected to the scoop by a fork, for example, in British Pat. No. 1,275,206, the two prongs of the fork are so placed as to grip the front edge of the bucket and they are then affixed thereto by through-bolts or by welding.

Teeth having a shank for connection to the scoop have the disadvantage that during operation disengagement of the key can occur, with consequent loss of the tooth. Moreover the shape of such a tooth does not always offer the best protection for the front edge of the bottom wall of the scoop. Teeth having a fork for connection to the scoop, however, due to symmetrical form and the way that connection is effected to the bottom wall of the scoop, as well as being firmer than the shank type connection and hence better able to withstand high stresses, are also better able to protect both the upper and lower surfaces of the bottom wall of the scoop. Such teeth have the disadvantage, however, of requiring replacement of the whole tooth when the tool body is worn out. This involves a considerable waste of material. One solution to this problem, which was attempted to avoid this disadvantage, is shown in the German Pat. No. 1,255,595. This involves providing the tooth with a removable tip, so that only the tip has to be replaced, and not the whole tooth when worn. In this case, however, there is the disadvantage that the removable tip has less mechanical strength than the one-piece tooth and is thus more susceptible to breakage and consequent loss of the tip. This disadvantage is further aggravated by the fact that whenever the loss of the tip is not noticed in time, damage also results to the fixed portion of the tooth which serves as holder for the removable tip.

OBJECTS OF THE INVENTION

One object of the present invention is to provide a two-part tooth for use on the bucket or scoop of an earth-moving machine, which has an equal strength to known one-piece teeth.

Another object of the invention is to provide a two-part tooth for use on the bucket or scoop of an earth-moving machine, which is able to provide the same protection to the edge of the wall of the bucket or scoop on which it is mounted as known one-piece fork-type teeth.

A further object of the invention is to provide a two-part tooth which satisfies the above objects of strength and protection while nevertheless having the advantage of ease of removal of one part of the tooth for replacement when worn, without requiring removal of the other part of the tooth.

SUMMARY OF THE INVENTION

According to the present invention, there is provided a tooth for the scoop of an earth-moving machine adapted to be assembled onto the free edge of the bottom wall of a scoop, characterised in that it comprises a first element, having an elongate portion which is shaped to fit over one of the two opposite surfaces of the bottom wall of the scoop, and a shaped projecting portion extending, when mounted on the bottom wall of the scoop, forwardly from the free edge thereof, and a second element having an elongated portion shaped to fit over the other surface of the bottom wall of the scoop in a position facing the elongate portion of the first element, and an enlarged projecting portion in the form of a tooth, extending, when mounted on the bottom wall of the scoop, forwardly from the free edge thereof, the shaped projecting portion of the first element and the projecting tooth portion of the second element being so shaped that they interengage one another such as to resist relative separating movement in a direction transverse the length of the elongate portions of the two elements.

Further characteristics and advantages of the invention will become apparent during the course of the following description with reference to the drawings, which are provided purely by way of non-restrictive example.

DESCRIPTION OF THE PREFERRED EMBODIMENTS.

Figure 1:
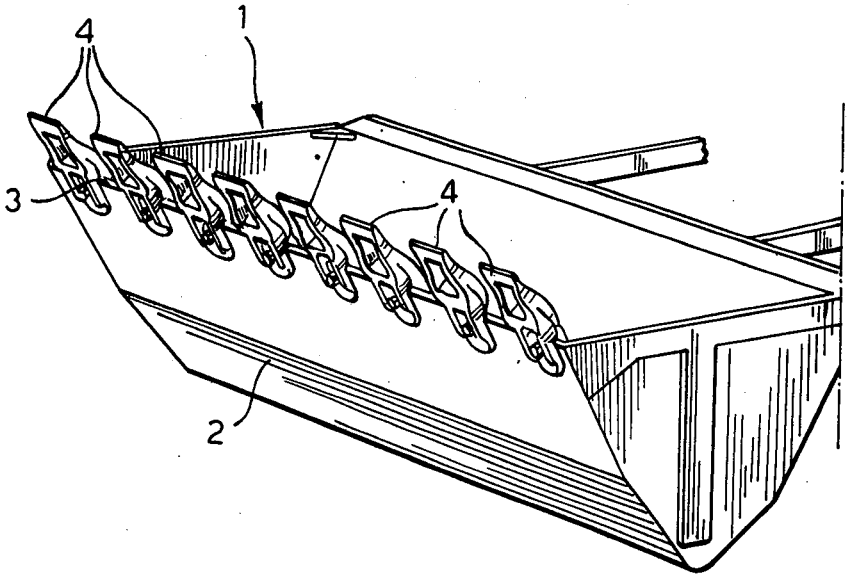
FIG. 1 is a perspective view of a scoop for an earth-moving machine, having teeth made according to the present invention.

Referring now to the drawings, there is shown in FIG. 1, a scoop 1 of an earth-moving machine (not illustrated). The bottom wall 2 of the scoop 1 has a free edge 3 sharpened as a blade, and carries a plurality of teeth 4 which project generally parallel to the bottom wall 2 from the sharpened free edge 3. Each tooth 4 comprises a first element 5, which are assembled on the upper surface of the bottom wall 2, and a second element 6 positioned, when assembled, on the lower surface of the bottom wall 2.

Figure 2:
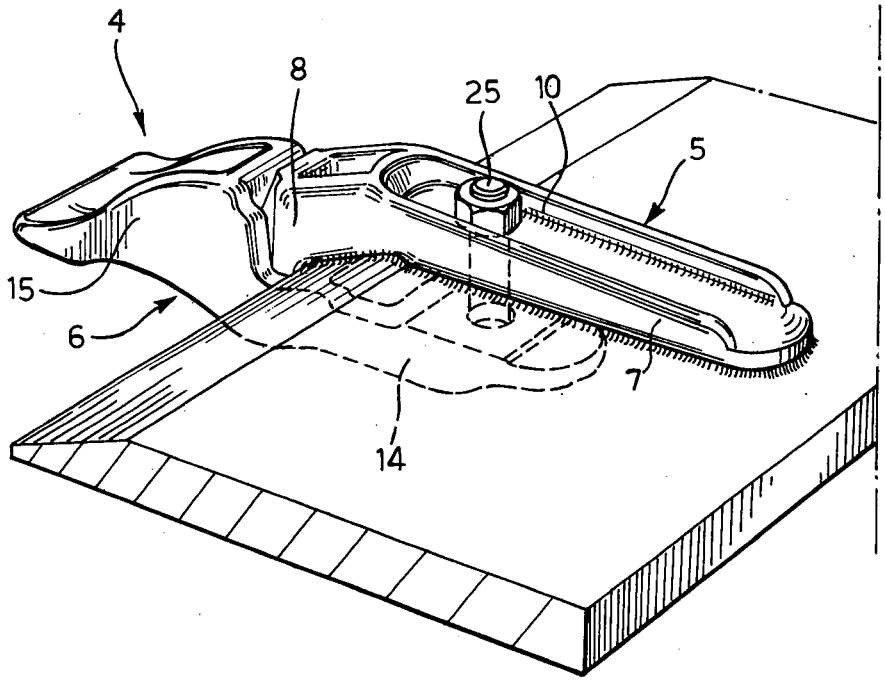
FIG. 2 is a perspective view of one of the teeth shown in FIG. 1.
Figure 3:
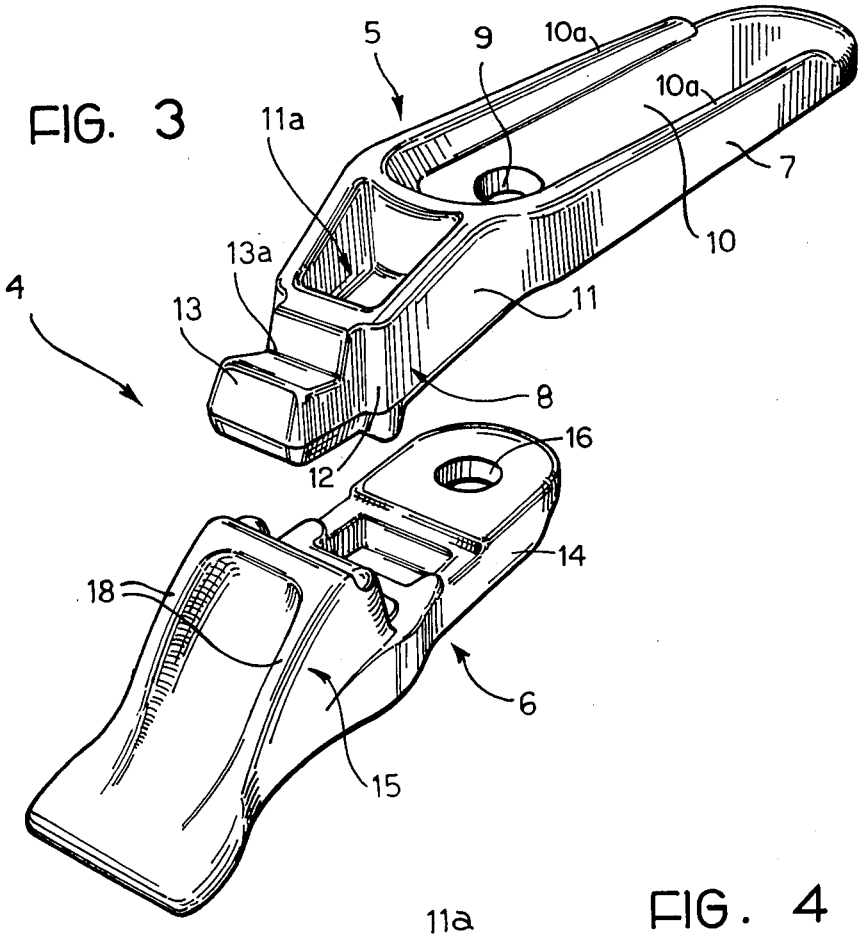
FIGS. 3 and 4 are exploded perspective views of the tooth shown in FIG. 2, from the front and the rear respectively.
Figure 4:
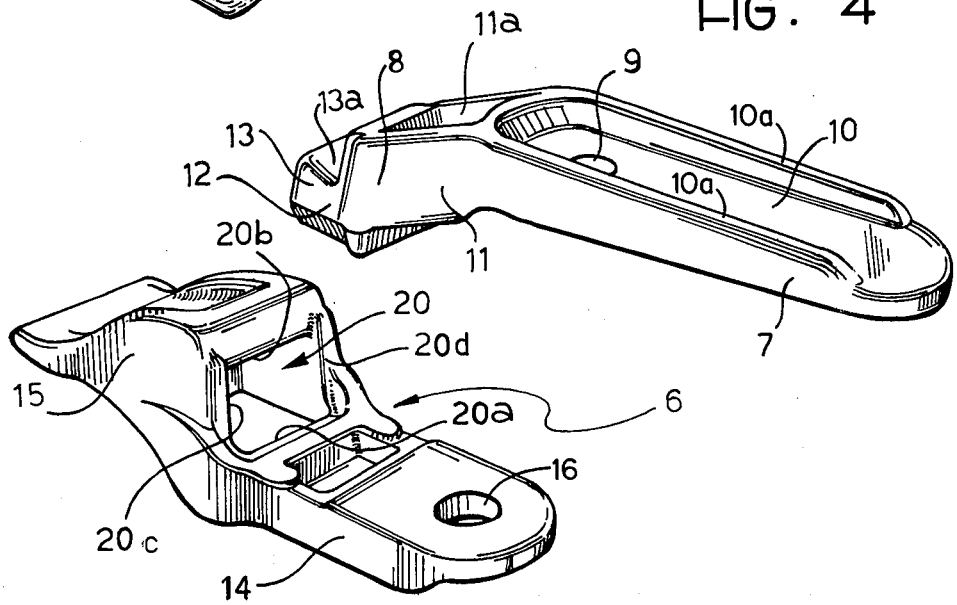
Figure 5:
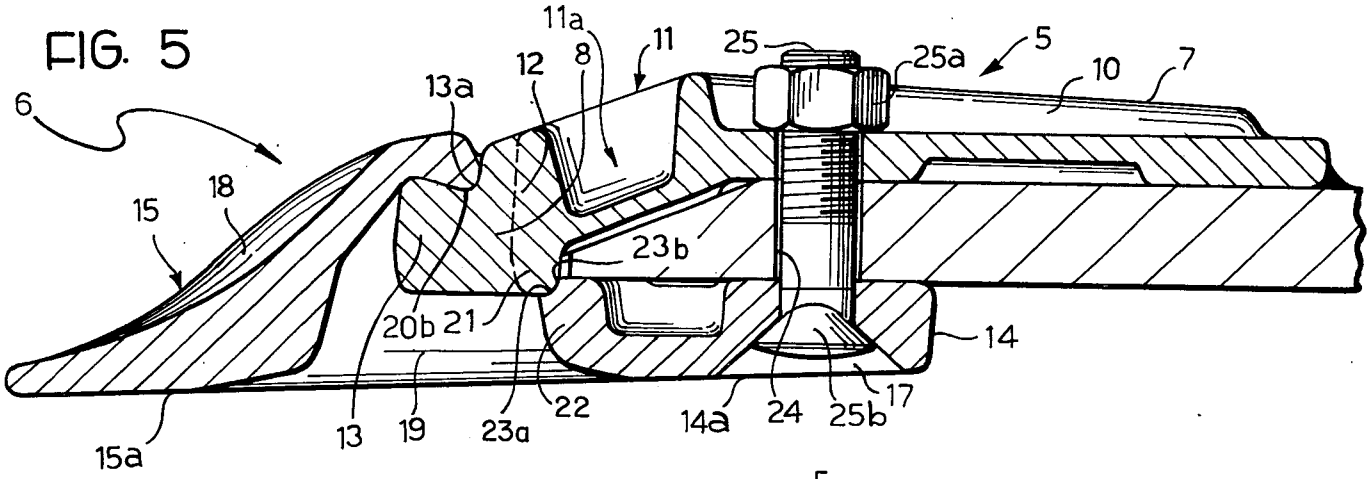
FIG. 5 is a section taken on the line V—V of FIG. 2.

The first element 5 of the tooth may be termed the fixed element, it has an elongate portion 7 which upon assembly of the tooth to the scoop is welded (FIG. 2) to the upper surface of the bottom wall 2 of the scoop 1, and a shaped projecting portion 8 which projects from the front edge of the bottom wall 2 of the scoop 1. The elongate portion 7 of the fixed element 5 has a through hole (FIG. 3 and 4) which, upon assembly of the tooth, is aligned with a corresponding hole 24, (FIG. 5) in the bottom wall 2 of the scoop 1, and has on its upper surface a longitudinal recess 10 defined by two parallel reinforcement ridges 10*a*. The projecting portion 8 of the fixed element 5 has a first part 11 inclined at an angle of about 30° to the plane of the elongate portion 7, and an enlarged end part 12. The inclined part 11 has, on its upper surface, a lightening recess 11*a*. The free end 13 of the end part 12 has, on its upper surface, a transverse groove 13*a*.

The second element 6 has an elongate portion 14 which is shaped to fit against the lower surface of the bottom wall 2 of the scoop 1, and which lies generally parallel to the elongate portion 7 of the first or fixed element 5 upon assembly of the tooth to the scoop. The second element 6 also has a projecting portion 15 in the form of a wedge-shape tooth from the wider end of which extends the elongate portion 14. The elongate portion 14 has a hole 16 which, when the tooth is assembled in position on the bottom wall 2 of a scoop 1, is aligned with the hole 9 of the first element and with the hole 24 of the wall 2 of the scoop 1. Through the aligned holes 9, 16, 24 passes a bolt 25 (FIG. 5) for clamping the said elongate portion 14 of the element to the bottom wall 2 of the scoop 1. The recess 10 in the elongate portion 7 of the fixed element 5 houses a nut 25*a* screwed onto the bolt 25 and the head 25*b* of the bolt 25 is housed in a cavity 17 in the lower surface of the elongate portion 14 of the second, removable, element 6.

The upper surface of the enlarged wedge-shape portion 15 (FIG. 3) has two lateral strengthening ridges 18. The lower face 15*a* (FIG. 5) of the enlarged wedge-shape portion 15 of the removable element 6 is continuous with the lower face 14*a* of the projecting portion 14, and has a recess 19 opening at the top into an aperture 20 (FIG. 4) in the rear surface of the enlarged wedge-shaped portion 15. The aperture 20 is substantially rectangular in shape and has four sides 20*a*, 20*b*, 20*c* and 20*d*. The upper side 20*b* is undercut to form a recess into which the free end 13 of the shaped portion 8 of the fixed element 5 can be inserted upon assembly of the tooth. When the free end 13 of the end part 12 of the shaped portion 8 of the first or fixed element is inserted into the aperture 20 (FIG. 5) and engaged in the recess behind the upper edge of the aperture 20, the side 20*b* of the aperture 20 itself engages into the transverse groove 13*a* of the said end part 12.

The end part 12 of the shaped portion 8 has on its lower surface, an appendage in the form of a heel 21 against which abuts a cooperating abutment 22 of the removable element 6. This abutment 22 (FIG, 5) of the removable element 6 has two surfaces 23*a*, 23*b* approximately perpendicular to one another, one, 23*a*, is generally parallel to the surface of the projecting portion 14 which faces the fixed element 5 upon assembly of the tooth, and the other 23*b* is generally perpendicular to this and facing forwardly.

Figure 6:
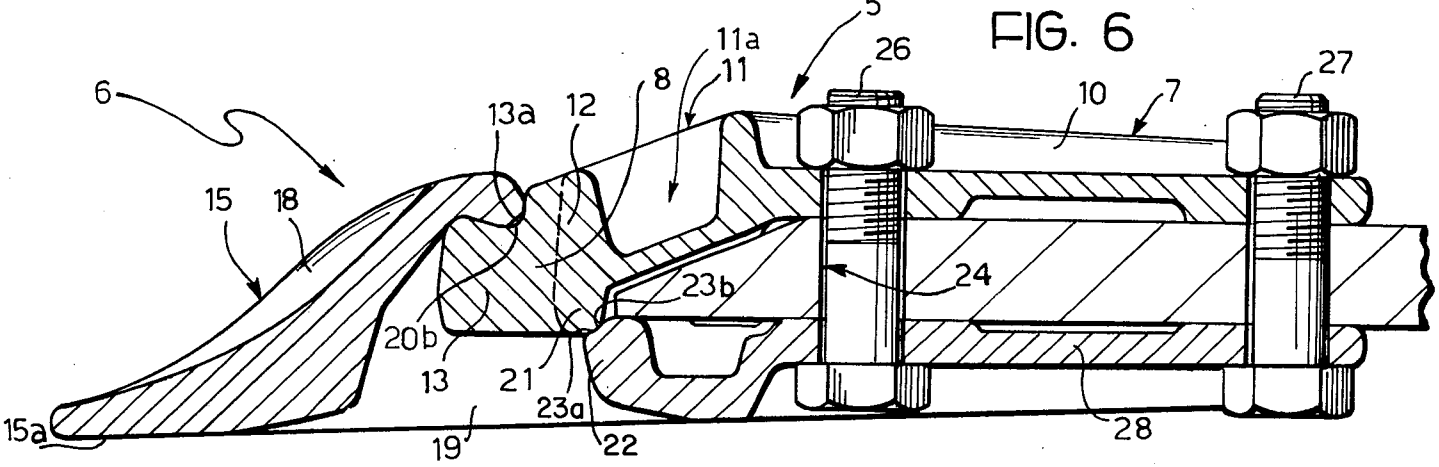
FIG. 6 is a section similar to that of FIG. 5, of an alternative embodiment of the invention.

In the embodiment of FIG. 6, connection of the removable element to the bottom wall 2 of the scoop 1 is effected by means of two bolts 26 and 27 instead on only one. In this case the elongate portion 28 of the removable element 6, is correspondingly larger than the elongate portion 14, of the embodiment illustrated in FIGS. 1 to 5. Moreover, in this embodiment, it is not necessary to weld the elongate portion 7 of the first element to the bottom wall 2 of the scoop 1.

Figure 7:
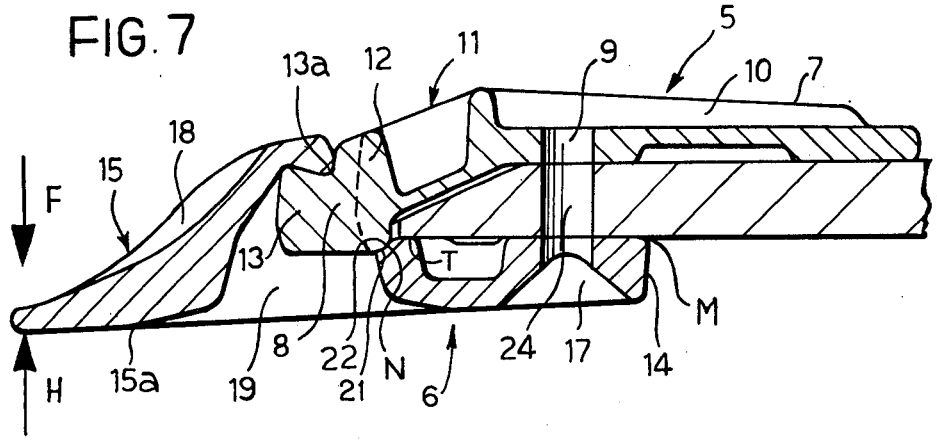
FIG. 7 is a sectional view of the tooth in an explanatory diagrammatic form.

Referring now to FIG. 7; suppose the tip of the tooth is loaded with a force perpendicular to the axis of the tooth, (this represents the most burdensome working condition), the arrow F represents a force directed downwards and the arrow F represents a force directed upwards. If the force F is exerted, the second removable element 6 would tend to rotate about the point M and the bolt 25, in the absence of the interengagement between the upper side 20*b* of the removable element 6 and groove 13*a* of the fixed element 5, would consequently have to resist alone the effect of force F, and thus it would be under great stress. However, this interengagement serves to transfer the action of the force F largely on to the fixed element 5.

On the other hand, when force H is exerted, then the removable element 6, would tend to rotate about the point N where the heel 21 of the fixed element 5 engages the abutment 22 of the facing surface of the removable element 6. In the absence of the heel 21 the removable element would tend to rotate about the point T which would put a greater stress on the bolt 25. The interengagement between the heel 21 and the abutment 22 thus increases the distance from the bolt 25 to the pivot point thus increasing its mechanical advantage and thereby requiring less strength to resist the stresses imposed on it during operation.

Figure 8:
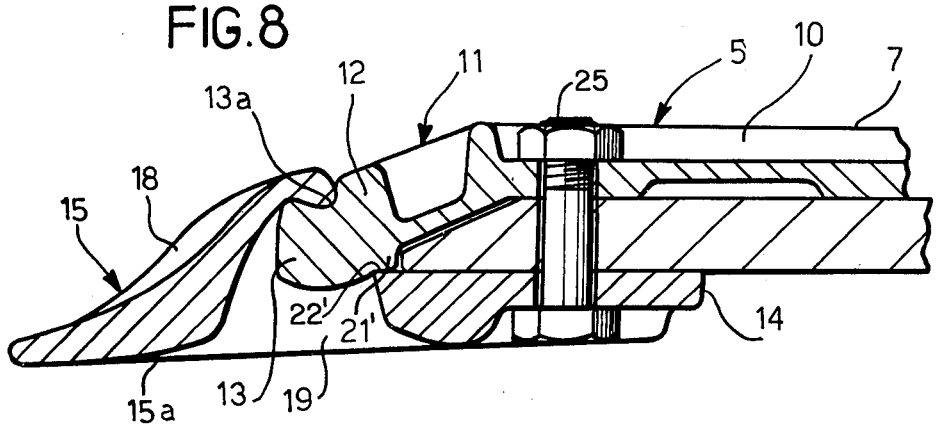
FIGS. 8 and 9 are sectional views of two further different forms of practical embodiment of the invention.
Figure 9:
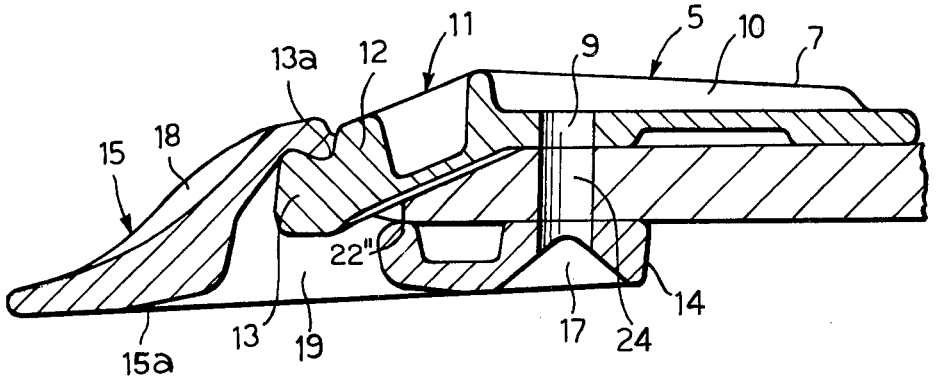

In the tooth illustrated in FIG. 8, the abutment 22′ which engages the heel 21′ is a single plane surface generally parallel to the plane of the bottom wall of the scoop. In the tooth illustrated in FIG. 9, the heel 21 is wholly eliminated and the abutment 22′ positioned so that it engages the bottom wall of the scoop which extends between the two elements 5 and 6. The embodiments of FIGS. 6 and 8, however, are best suited for use in machines of high power where the forces to which the teeth are subjected in use are very considerable.

We claim:

1. A tooth for the scoop of an earth-moving machine, to be assembled onto the free edge of the bottom wall of said scoop, said tooth comprising:

a first tooth element having, an elongate portion shaped to fit onto one face of said bottom wall of said scoop, and a shaped projecting portion which extends forwardly of said free edge of said bottom wall of said scoop when said first tooth element is fitted thereto, a second tooth element having, an elongate portion shaped to fit onto the other face of said bottom wall of said scoop directly opposite said elongate portion of said first tooth element, and an enlarged wedge-shaped projecting portion, said wedge-shaped projecting portion extending forwardly from the free edge of said bottom wall when said second tooth element is mounted thereon, said wedge-shaped projecting portion of said second tooth element having a rear surface and two inclined surfaces which diverge rearwardly to said rear surface, means defining an aperture in said rear surface, said aperture communicating with an interior cavity within said wedge-shaped projecting portion, one of said two inclined surfaces of said wedge-shaped projecting portion being generally continuous with that surface of said elongate portion of said second element which is remote from said bottom wall of the scoop upon assembly of the tooth thereto, the edge of said aperture in said rear surface of said wedge-shaped projecting portion remote from said elongate portion of said second element being undercut to form a lip under which engages the end of said shaped projecting portion of said first tooth element, and means defining a transverse groove in said end of said shaped projecting portion of said first tooth element, said transverse groove receiving said lip upon assembly of said two tooth elements whereby said first and second tooth elements are interengaged and locked together to resist relative separating movement in a direction transverse the length of said elongate portions of said first and second tooth elements.

2. The tooth of claim 1, wherein said shaped projecting portion of said first tooth element has a projecting heel on the surface thereof which faces towards said second tooth element, said heel engaging with a cooperating abutment on the facing surface of said second tooth element.

3. The tooth of claim 2, wherein said cooperating abutment on the surface of said second tooth element which faces towards said first tooth element has two mutually perpendicular abutment surfaces which both engage said heel of said first tooth element, one of said abutment surfaces lying generally parallel to the length of the elongate portion of said second tooth element, and the other of said abutment surfaces lying generally perpendicular to said one surface.

* * * * *